US009967660B2

(12) United States Patent
Tawada

(10) Patent No.: US 9,967,660 B2
(45) Date of Patent: May 8, 2018

(54) SIGNAL PROCESSING APPARATUS AND METHOD

(71) Applicant: CANON KABUSHIKI KAISHA, Tokyo (JP)

(72) Inventor: Noriaki Tawada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/237,707

(22) Filed: Aug. 16, 2016

(65) Prior Publication Data

US 2017/0064444 A1 Mar. 2, 2017

(30) Foreign Application Priority Data

Aug. 28, 2015 (JP) ..... 2015-169731

(51) Int. Cl.
*H04R 3/00* (2006.01)
*H04S 7/00* (2006.01)

(52) U.S. Cl.
CPC ..... *H04R 3/005* (2013.01); *H04S 7/307* (2013.01); *H04R 2430/23* (2013.01); *H04S 2400/15* (2013.01); *H04S 2420/01* (2013.01)

(58) Field of Classification Search
None
See application file for complete search history.

(56) References Cited

U.S. PATENT DOCUMENTS

| | | | | |
|---|---|---|---|---|
| 4,868,682 | A * | 9/1989 | Shimizu | H04N 5/77 348/38 |
| 5,233,664 | A * | 8/1993 | Yanagawa | H04R 1/403 381/182 |
| 8,199,925 | B2 * | 6/2012 | Konagai | H04R 1/403 381/116 |
| 9,554,203 | B1 * | 1/2017 | Pavlidi | H04R 1/08 |
| 2001/0007969 | A1 * | 7/2001 | Mizushima | G01S 3/8086 702/76 |
| 2015/0208169 | A1 | 7/2015 | Tawada | |

FOREIGN PATENT DOCUMENTS

| | | | |
|---|---|---|---|
| JP | 2515101 | B2 | 7/1996 |
| JP | H09-55925 | A | 2/1997 |
| JP | 4241825 | B2 | 3/2009 |
| JP | 5024792 | B2 | 9/2012 |
| JP | 5648760 | B1 | 1/2015 |
| WO | 2005/115250 | A1 | 12/2005 |

* cited by examiner

*Primary Examiner* — Paul Huber
(74) *Attorney, Agent, or Firm* — Carter, DeLuca, Farrell & Schmidt, LLP

(57) ABSTRACT

A signal processing apparatus is provided. The apparatus includes an obtaining unit configured to obtain direction sounds in respective directivity directions from audio signals picked up by a plurality of sound pickup units, and a control unit configured to control, in accordance with a frequency of the direction sounds obtained by the obtaining unit, a directivity direction count indicating the number of directivity directions corresponding to the direction sounds obtained by the obtaining unit.

17 Claims, 10 Drawing Sheets

SIGNAL PROCESSING APPARATUS AND METHOD

BACKGROUND OF THE INVENTION

Field of the Invention

The present invention relates to a signal processing technique and, more particularly, to an audio signal processing technique.

Description of the Related Art

There is known a technique of obtaining sounds (to be referred to as "direction sounds" hereinafter) in respective directions from the audio signals of a plurality of channels recorded by a plurality of microphone elements (a microphone array). If direction sounds in all directions can be presented to the user using this technique so that they are reproduced from the respective directions, it is possible to obtain high presence as if the user were in a sound recording site.

Japanese Patent No. 2515101 discloses an multi-directional recording/reproducing system for obtaining direction sounds in respective directivity directions by a directional microphone array in which eight directional microphones each having a directivity of about 45° are radially arranged, and performing reproduction by eight surrounding speakers arranged at an interval of 45° in the respective directivity directions.

As a method of obtaining direction sounds, there is provided a method based on filtering in addition to the method using the directional microphone array. That is, it is possible to generate a direction sound in an arbitrary directivity direction by applying a directivity forming filter coefficient corresponding to a desired directivity direction to the audio signals of a plurality of channels recorded by a (nondirectional) microphone array, and adding the thus obtained values. In Japanese Patent Laid-Open No. 9-055925, 8 channel audio signals recorded by a microphone array formed by eight microphones are filtered (undergo delay control), thereby forming directivities to be equal to those of the directional microphones required by the user, and generating direction sounds the number of which is requested by the user.

As a method of presenting direction sounds in all directions to the user so that they are reproduced from the respective directions, there is provided a method of performing binaural audio reproduction using headphones in addition to a method of arranging speakers around the user. That is, by applying, to each direction sound, the head-related transfer functions of the right and left ears in a direction corresponding to each directivity direction, adding the thus obtained values to the right and left signals, and reproducing the resultant signals from the headphones, it is possible to obtain the same effects as those obtained when virtual speakers are arranged around the user.

In general, in either of a case in which the directional microphone array is used to obtain direction sounds and a case in which directivities are formed by filtering to obtain direction sounds, the beam pattern of a formable directivity tends to be flat in a low frequency range and sharp in a high frequency range. At this time, if, in order to perform multi-directional recording/reproduction, direction sounds in the respective directivity directions equally arranged based a predetermined directivity direction count and binaural audio reproduction is performed by headphones, the following problem arises.

That is, overlapping of the beam patterns of the respective directivities increases in the low frequency range, and the direction sense of a (point) sound source becomes unclear and a volume tends to be excessively high. In the high frequency range, overlapping of the beam patterns of the respective directivities decreases, and recesses are generated between the respective directivity directions in a combined beam pattern obtained by combining the respective beam patterns. Therefore, the volume balances between sound sources (for example, between musical instruments arranged in all directions) are lost, and the volume units of ambient sounds (diffused sound sources) in all directions are different in the respective directions.

The above-described Japanese Patent No. 2515101 and Japanese Patent Laid-Open No. 9-055925 disclose no methods of solving the problem caused by a directivity difference for each frequency.

SUMMARY OF THE INVENTION

The present invention provides, for example, a technique advantageous in clarifying the direction sense of a sound source and making the volume balances in the respective directions uniform.

According to one aspect of the present invention, a signal processing apparatus is provided. The apparatus includes an obtaining unit configured to obtain direction sounds in respective directivity directions from audio signals picked up by a plurality of sound pickup units, and a control unit configured to control, in accordance with a frequency of the direction sounds obtained by the obtaining unit, a directivity direction count indicating the number of directivity directions corresponding to the direction sounds obtained by the obtaining unit.

Further features of the present invention will become apparent from the following description of exemplary embodiments (with reference to the attached drawings).

DESCRIPTION OF THE EMBODIMENTS

Figure 1:
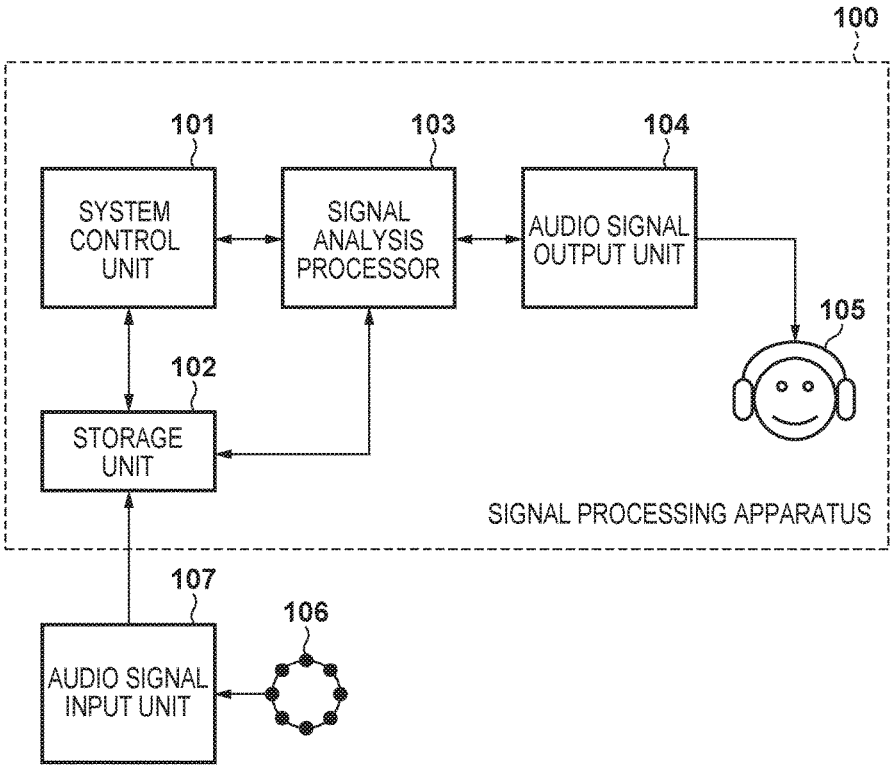
FIG. 1 is a block diagram showing a signal processing apparatus according to the first embodiment.

Various exemplary embodiments, features, and aspects of the invention will be described in detail below with reference to the drawings. Note that the present invention is not limited to the following embodiments, and not all combinations of features explained in the following embodiments are essential for the present invention to solve the problem. The same reference numerals denote the same members or elements throughout the drawings, and a repetitive description thereof will be omitted.

First Embodiment

FIG. 1 is a block diagram showing the arrangement of a signal processing apparatus 100 according to the first embodiment. The signal processing apparatus 100 includes a system control unit 101 for comprehensively controlling respective components, a storage unit 102 for storing various data, and a signal analysis processor 103 for performing signal analysis processing. The storage unit 102 holds audio signals picked up by a microphone array 106 including a plurality of microphone elements (sound pickup units). An audio signal input unit 107 inputs the audio signals from the microphone array 106.

The signal processing apparatus 100 includes a reproducing system for generating direction sound images as the sound images of direction sounds around the user. In this embodiment, the reproducing system includes an audio signal output unit 104 and headphones 105. This reproducing system can apply, to each direction sound, HRTFs (Head-Related Transfer Functions) in a direction corresponding to each directivity direction, thereby performing reproduction near both ears of the user. The signal analysis processor 103 generates, by signal analysis processing (to be described later), headphone reproduction signals to be reproduced from the headphones 105. The audio signal output unit 104 outputs, to the headphones 105, signals obtained by performing D/A conversion and amplification for the headphone reproduction signals.

Figure 2A:
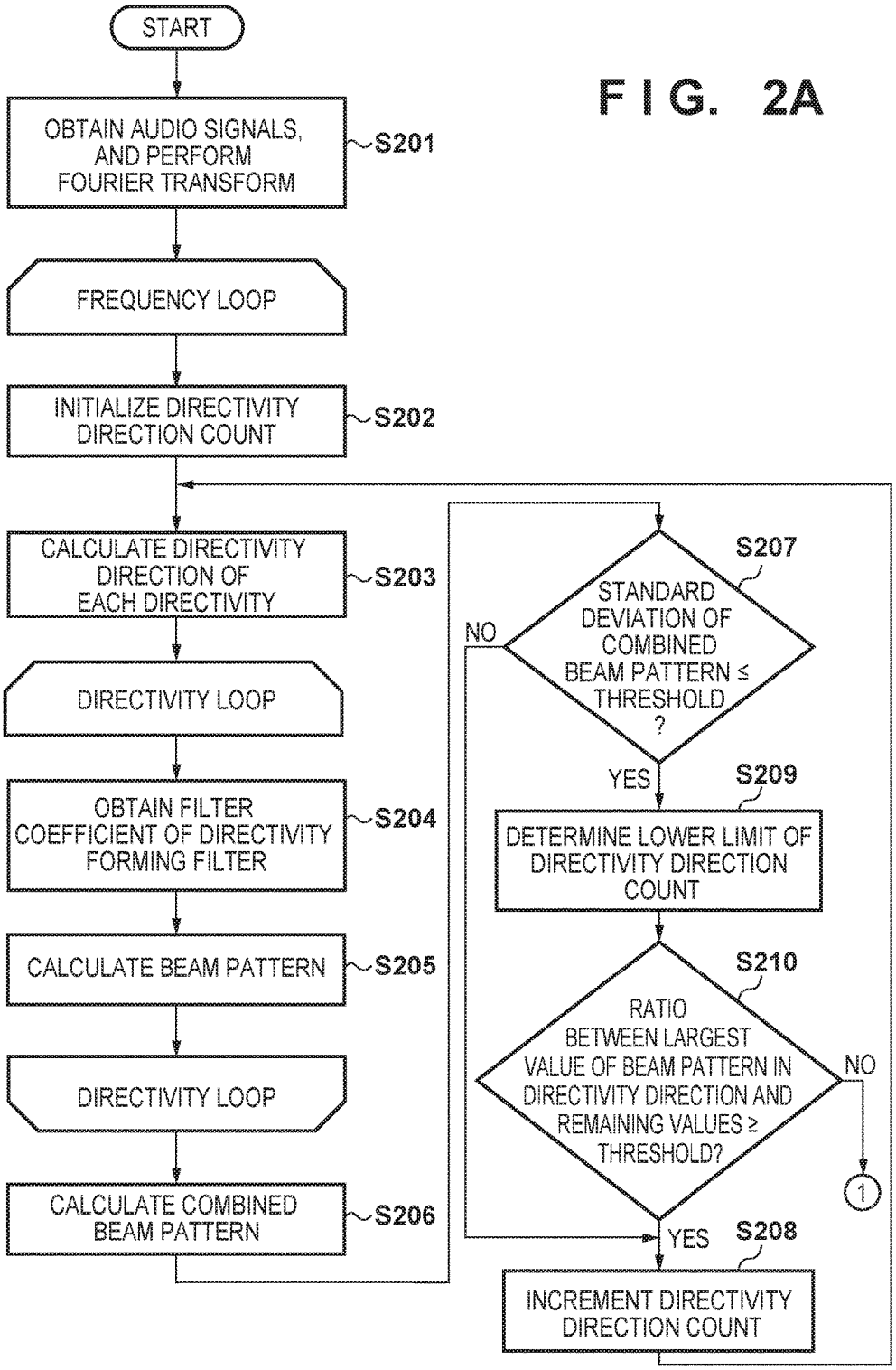
FIGS. 2A and 2B are flowcharts illustrating signal processing according to the first embodiment.
Figure 2B:
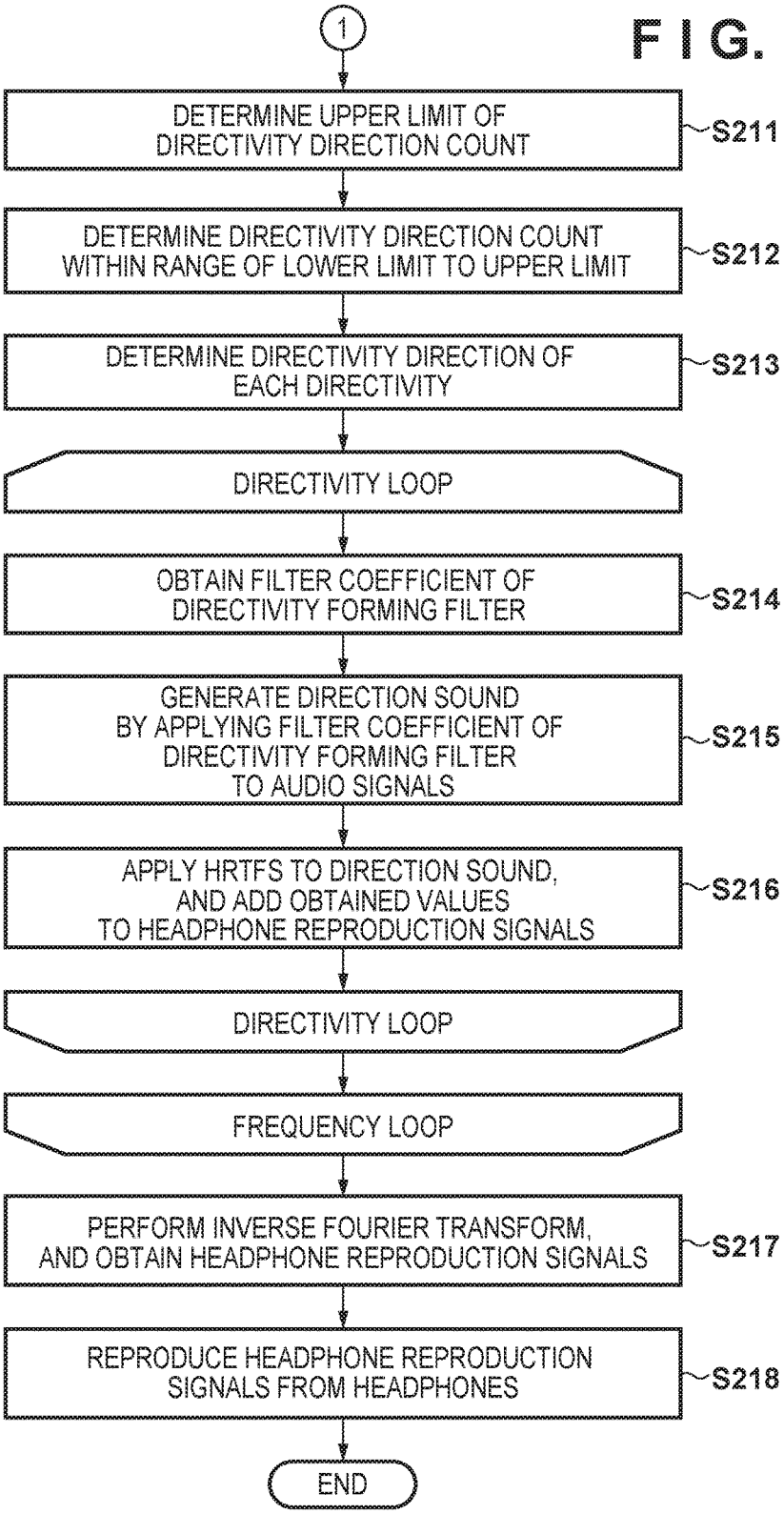

Signal processing according to this embodiment will be described below with reference to flowcharts shown in FIGS. 2A and 2B. Note that programs corresponding to the flowcharts shown in FIGS. 2A and 2B are held in, for example, the storage unit 102, and executed by the signal analysis processor 103, unless otherwise specified.

In step S201, M channel audio signals which have been recorded by M microphone elements (M-channel microphone array) and are held in the storage unit 102 are obtained, and Fourier transform is performed for each channel, thereby obtaining data (Fourier coefficients) z(f) in a frequency domain. Note that z(f) at each frequency is a vector having M elements.

Steps S202 to S216 are processes for each frequency, and are performed in a frequency loop.

In step S202, a directivity direction count D(f) at the frequency in the current frequency loop is initialized to D(f)=1. In step S203, directivity directions $\theta_d(f)$ [d=1, . . . , D(f)] of the respective directivities are calculated using the directivity direction count D(f). In this example, since a plurality of directivities cover all horizontal directions, the horizontal directivity direction (azimuth) is calculated by $\theta_d(f)=(d-1)\times 360°/D(f)$ by setting, as a reference direction, the front direction of 0° in the coordinate system of the microphone array which has recorded the audio signals. Note that a directivity direction exceeding 180° is represented by $\theta_d(f)\leftarrow\theta_d(f)-360°$.

Steps S204 and S205 are processes for each directivity for which the directivity direction has been calculated in step S203, and are performed in a directivity loop.

In step S204, the filter coefficient of a directivity forming filter for forming a directivity set as a target in the current directivity loop is obtained. In this example, $w_d(f)$ corresponding to the directivity direction $\theta_d(f)$ is obtained from the filter coefficients of directivity forming filters held in advance in the storage unit 102. The filter coefficient (vector) $w_d(f)$ is data (Fourier coefficient) in the frequency domain, and is formed by M elements. Note that if the arrangement of the microphone array is different, the filter coefficients are also different. Thus, the type ID of the microphone array used for sound recording may be recorded as additional information of the audio signals at the time of sound recording, and the filter coefficient corresponding to the microphone array may be used in this step.

To calculate the filter coefficient of the directivity forming filter, an array manifold vector a(f, θ) as a transfer function between a sound source in each direction (azimuth θ) and each microphone element is generally used. Note that a(f, θ) is data (Fourier coefficient) in the frequency domain, and is formed by M elements. If, for example, a delay-and-sum method is used as a method of making a directional main lobe face in the directivity direction $\theta_d(f)$, an array manifold vector $a_d(f)$ in the direction $\theta_d(f)$ is used to obtain a filter coefficient by $w_d(f)=a_d(f)/(a_d^H(f)a_d(f))$.

In step S205, the beam pattern of the directivity is calculated using the filter coefficient $w_d(f)$ of the directivity forming filter obtained in step S204 and the array manifold vector a(f, θ). A value $b_d(f, \theta)$ in the direction of the azimuth θ of the beam pattern is obtained by:

$$b_d(f,\theta)=w_d^H(f)a(f,\theta) \tag{1}$$

By calculating $b_d(f, \theta)$ while changing θ of a(f, θ) by increments of 1° within the range of, for example, −180° to 180°, beam patterns in all the horizontal directions are obtained. Note that depending on the structure of the microphone array used to record the audio signals, the array manifold vector a(f, θ) can be calculated at an arbitrary resolution by a theoretical equation for a free space, a rigid ball, or the like. Note that if microphone elements are isotropically arranged like a circular equal-interval microphone array, it is possible to obtain a beam pattern $b_d(f, \theta)$ [d=2, . . . ] of another directivity by rotating a beam pattern $b_1(f, \theta)$ obtained when the directivity direction is the front direction of 0°.

In step S206, by combining the beam patterns $b_d(f, \theta)$ [d=D(f)] of the respective directivities calculated in step S205, a combined beam pattern $b_{sum}(f, \theta)$ is calculated by:

$$b_{sum}(f,\theta)=\sqrt{\tau_{d=1}^{D(f)} b_d^2(f,\theta)} \tag{2}$$

Figure 3:
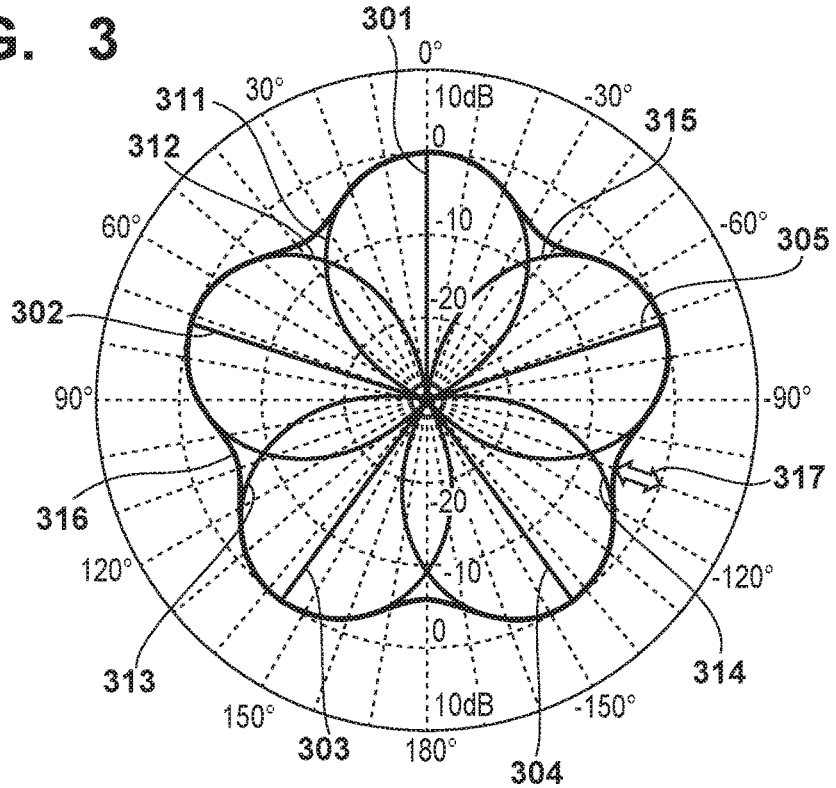
FIG. 3 is a view showing examples of beam patterns when a directivity direction count is 5.

If the directivity direction count D(f) is short with respect to the directivities formed at the current frequency, overlapping of beam patterns 311 to 315 of the respective directivities, whose main lobes are respectively made to face in directivity directions 301 to 305, decreases, as shown in FIG. 3 [example of D(f)=5]. As a result, in a combined beam pattern 316 obtained by combining the respective beam patterns, recesses are generated between the respective directivity directions 301 to 305, and thus the volume balances between the sound sources are lost, and the volume units of the ambient sounds in all directions are different in the respective directions.

To cope with this, in step S207, a standard deviation $\sigma_{bsum}(f)$ is calculated as a measure of the recess amount of the combined beam pattern $b_{sum}(f, \theta)$ calculated in step S206, and it is determined whether this value is equal to or smaller than a threshold. Let $\delta_1$ be the threshold. If the calculated standard deviation $\sigma_{bsum}(f)$ is larger than the threshold $\delta_1$, it is considered that the directivity direction count D(f) is short, and the process advances to step S208;

otherwise, the process advances to step S209. Note that the standard deviation $\sigma_{bsum}(f)$ is calculated from, for example, $b_{sum}(f, \theta)$ expressed by dB. Note also that the difference (a double-headed arrow 317 in the example of FIG. 3) between the largest and smallest values of $b_{sum}(f, \theta)$ may be set as a measure of the recess amount, and compared with a threshold $\delta_2$. In this case, $b_{sum}(f, \theta)$ takes the largest value in each directivity direction, and takes the smallest value in the middle between adjacent directivity directions.

If the process advances to step S208, the directivity direction count D(f) is incremented, as represented by D(f)←D(f)+1, and the process returns to step S203.

If the process advances to step S209, it is considered that the directivity direction count falls within an appropriate range, and the directivity direction count D(f) at this time is determined as a lower limit directivity direction count $D_{min}(f)$ as the lower limit value of the directivity direction count at the current frequency.

Figure 4:
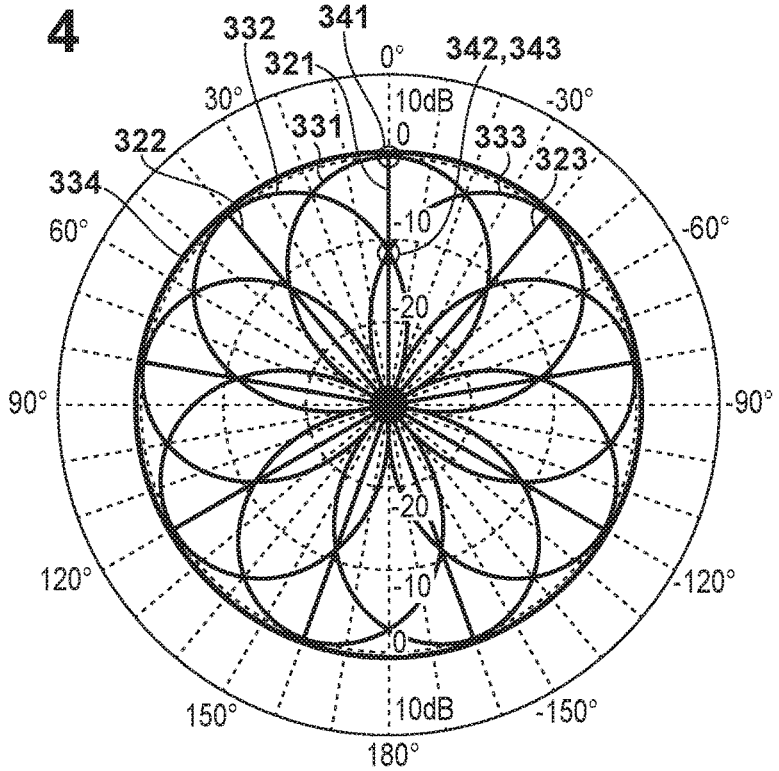
FIG. 4 is a view showing examples of beam patterns when the directivity direction count is 9.

If the directivity direction count D(f) becomes appropriate for the directivity formed at the current frequency, the recesses disappear and an almost circular combined beam pattern 334 is obtained, as shown in FIG. 4 [example of D(f)=9].

Figure 5:
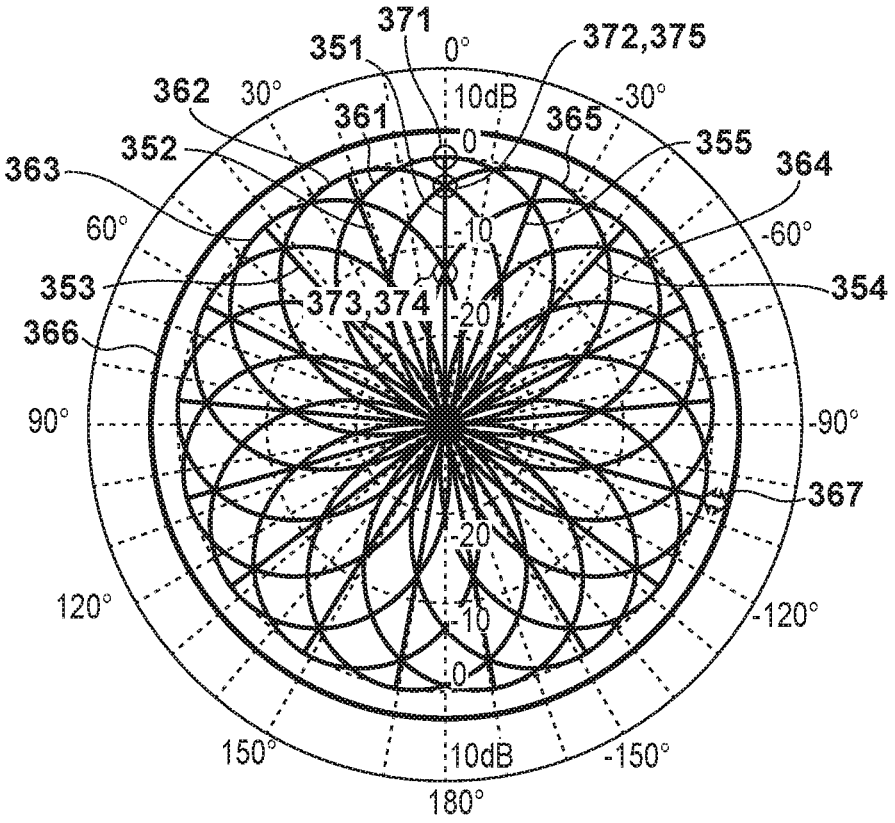
FIG. 5 is a view showing examples of beam patterns when the directivity direction count is 17.

If the directivity direction count D(f) becomes excessively large for the directivity formed at the current frequency, overlapping of the beam patterns of the respective directivities increases, as shown in FIG. 5 [example of D(f)=17]. Consequently, the direction sense of the sound source becomes unclear, and the volume tends to be excessively high. However, if the directivity direction count is excessively large, no disturbance of a combined beam pattern occurs, unlike a case in which the directivity direction count is short. An almost circular combined beam pattern 366 shown in FIG. 5 is obtained, and thus it is necessary to consider another evaluation method. Note that since the shape (area) of each beam pattern depends on setting (in FIG. 3, between −30 dB and 10 dB) of a display range in drawing, the area ratio of the overlapping portion of the respective beam patterns to the entire area or the like is not suitable as an evaluation index.

The use of the ratio of the values of the respective beam patterns in a predetermined direction as an evaluation index is considered. An index $d_{max}(f, \theta)$ of the directivity which provides the largest value of the beam pattern in each direction is given by:

$$d\max(f, \theta) = \underset{d}{\operatorname{argmax}} b_d(f, \theta) \tag{3}$$

Let $b_{dmax}(f, \theta)$ be the largest value of the beam pattern in each direction. Then, a ratio $r(f, \theta)$ between the largest value of the beam pattern in each direction and the remaining values is given by:

$$r(f, \theta) = \sqrt{\frac{b_{dmax}^2(f, \theta)}{\sum_{d=1}^{D(f)} b_d^2(f, \theta) - b_{dmax}^2(f, \theta)}} \tag{4}$$

When the directivity direction count is appropriate, as shown in FIG. 4, if a sound source exists in, for example, a directivity direction 321, $r(f, \theta_1)$ in the directivity direction $\theta_1(f)=0°$ takes a positive value such as 8 dB. That is, sound energy 341 captured by a beam pattern 331 whose main lobe is made to face in the directivity direction 321 is higher than the sum of sound energies 342 and 343 captured by beam patterns 332 and 333 whose main lobes are respectively made to face in directivity directions 322 and 323. That is, if a sound source exists in a given direction, sound energy captured by a directivity which makes the main lobe face in that direction is higher than the sum of sound energies captured by directivities which respectively make the main lobes face in other directions. Thus, the state is considered to be appropriate.

On the other hand, when the directivity direction count is excessively large, as shown in FIG. 5, if a sound source exists in, for example, a directivity direction 351, $r(f, \theta_1)$ in the directivity direction $\theta_1(f)=0°$ takes, for example, a small value less than 0 dB. That is, the sum of sound energies 372 to 375 captured by beam patterns 362 to 365 whose main lobes are respectively made to face in directivity directions 352 to 355 is higher than sound energy 371 captured by a beam pattern 361 whose main lobe is made to face in the directivity direction 351. That is, if a sound source exists in a given direction, the sum of energies captured by directivities which respectively make the main lobes face in other directions is higher than sound energy captured by a directivity which makes the main lobe face in that direction. Thus, the state is considered to be inappropriate.

In consideration of the above points, in step S210, the ratio $r(f, \theta_d(f))$ between the largest value of the beam pattern in the directivity direction $\theta_d(f)$ and the remaining values is calculated, and it is determined whether the calculated value is equal to or larger than a threshold. Let $\delta_3$ be the threshold. If the value of the calculated ratio is equal to or larger than the threshold $\delta_3$ (for example, 0 dB), it is considered that the directivity direction count D(f) still falls within the appropriate range, and the process advances to step S208; otherwise, the process advances to step S211. Note that $r(f, \theta)$ in a direction other than the directivity direction $\delta_d(f)$ may be compared with a threshold $\delta_4$. However, since $r(f, \theta)$ becomes highest in the directivity direction $\theta_d(f)$, for example, $\delta_4<\delta_3$ is set in this embodiment.

Note that if overlapping of the beam patterns of the respective directivities increases, the value of the combined beam pattern 366 becomes large, as shown in FIG. 5, and thus the volume tends to be excessively high. To solve this problem, the difference (a double-headed arrow 367 in the example of FIG. 5) between the largest value $b_{sum}(f, \theta_d(f))$ of the combined beam pattern and the largest value $b_d(f, \theta_d(f))$ [0 dB if normalization has been performed] of each beam pattern may be compared with a threshold $\delta_5$. That is, if $b_{sum}(f, \theta_d(f))-b_d(f, \theta_d(f))$ is equal to or smaller than $\delta_5$, it may be considered that the directivity direction count D(f) still falls within the appropriate range, and the process may advance to step S208; otherwise, the process may advance to step S211.

If the process advances to step S208, the directivity direction count D(f) is incremented, as represented by D(f)←D(f)+1, and the process returns to step S203. Note that the lower limit value $D_{min}(f)$ of the directivity direction count has already been determined, and thus steps S207 and S209 are skipped.

If the process advances to step S211, it is considered that the directivity direction count falls outside the appropriate range, and D(f)−1 obtained by subtracting 1 from the directivity direction count D(f) at this time is determined as an upper limit directivity direction count $D_{max}(f)$ as the upper limit value of the directivity direction count at the current frequency.

Figure 6A:
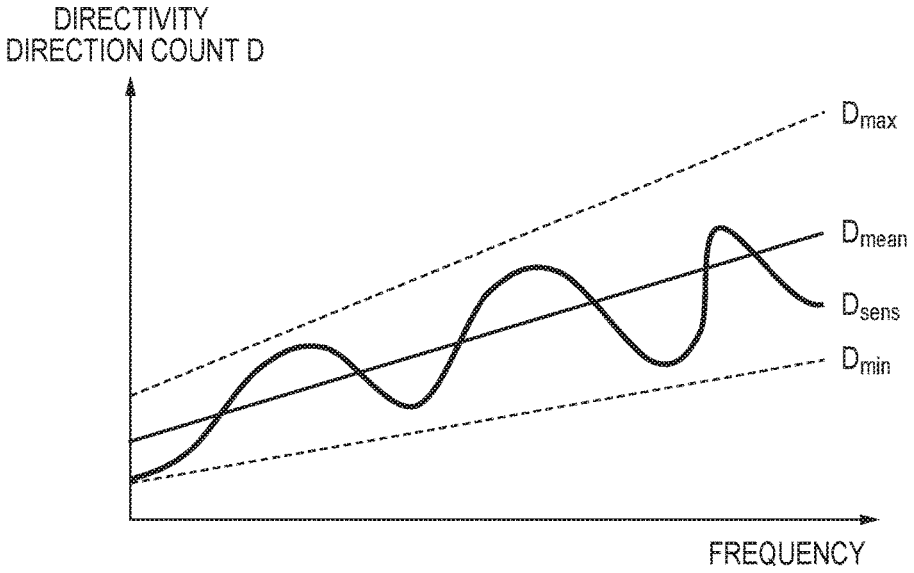
FIGS. 6A and 6B are graphs for explaining the directivity direction count for each frequency.

In general, the beam pattern of a formable directivity tends to be flat in the low frequency range and sharp in the high frequency range. Therefore, if the beam patterns are evaluated for each frequency as in steps S207 and S210, the lower limit directivity direction count $D_{min}(f)$ and the upper limit directivity direction count $D_{max}(f)$ are larger in the higher frequency range than in the low frequency range, as schematically shown in FIG. 6A. The directivity direction count at each frequency is determined as $D(f)=D_{mean}(f)$ given by:

$$D_{mean}(f) = \text{round}\left(\frac{D_{min}(f) + D_{max}(f)}{2}\right) \tag{5}$$

With this processing, the directivity direction count is larger in the high frequency range than in the low frequency range, and the directivity direction counts at all the frequencies fall within the appropriate range. Consequently, the direction sense of the sound source is clear and the volume balances in the respective directions are uniform.

Consider a case in which the directivity direction count D(f) at each frequency is appropriately determined within the range of $D_{min}(f)$ to $D_{max}(f)$ in consideration of the sensitivity characteristic of a human at each frequency with respect to the sound source direction.

Figure 7:
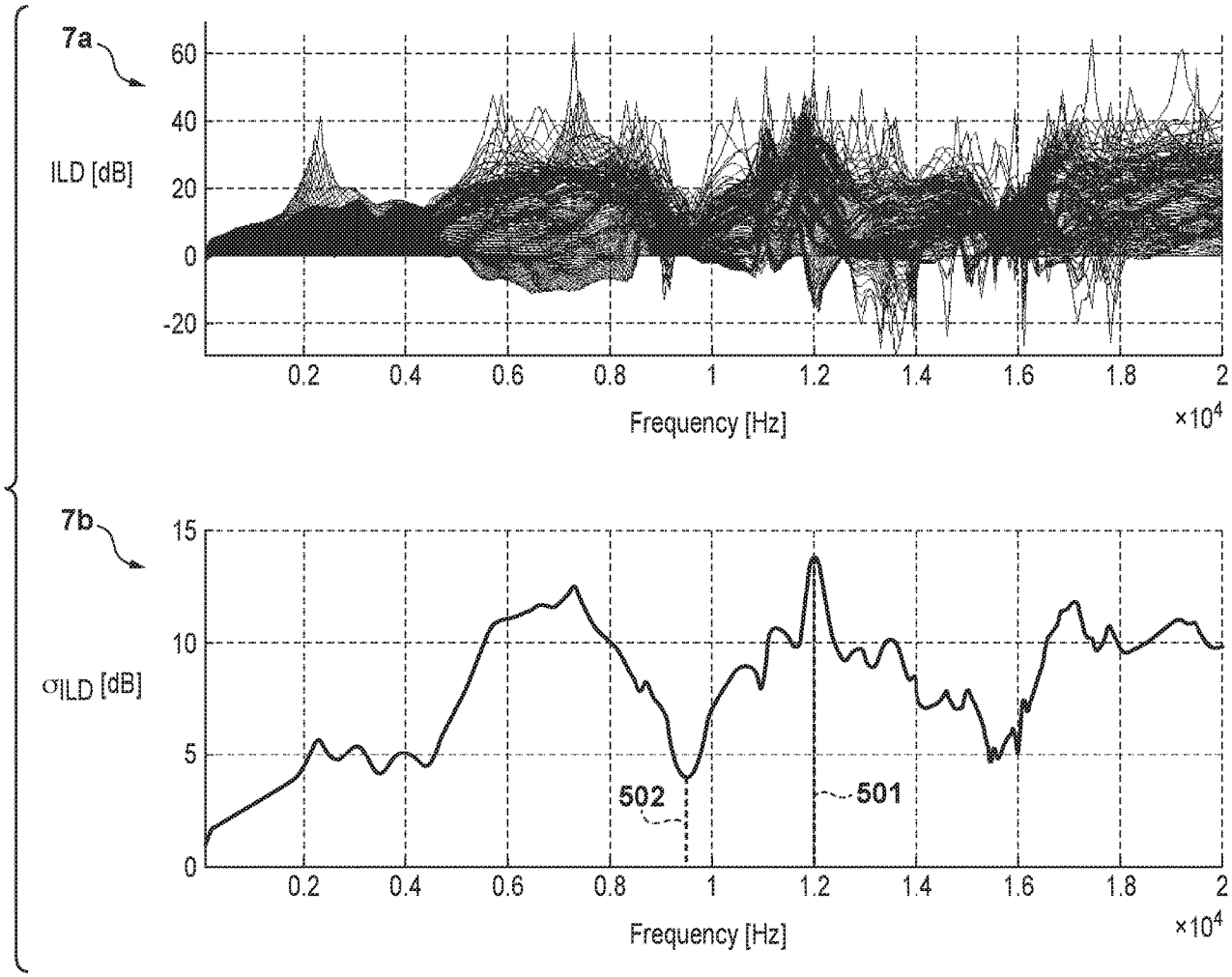
FIG. 7 shows graphs for explaining the frequency-specific direction sensitivity of head-related transfer functions.

In FIG. 7, 7*a* shows 181 graphs in total which are drawn with respect to an interaural level difference (ILDs) at each frequency calculated from the HRTFs by changing the sound source direction by every 1° within the range of 0° to 180°. Note that graphs when the sound source direction falls within the range of 0° to −180° are generally obtained by inverting the signs of 7*a* (inverting 7*a* in the vertical direction). Furthermore, 7*b* shows a standard deviation $\sigma_{ILD}(f)$ for each frequency of each graph in 7*a*.

The sensitivity (direction sensitivity) of a human to the sound source direction corresponds to a change amount with respect to the direction of the interaural level difference of the HRTFs. For example, a frequency at which $\sigma_{ILD}(f)$ is large, that is, a frequency at which a change in ILD depending on the direction is large is a frequency at which the sensitivity (direction sensitivity) of a human to the sound source direction is high. As indicated by a dotted line 501, at a frequency at which $\sigma_{ILD}(f)$ is large, it is considered that a human readily recognizes a difference for each direction, and thus the directivity direction count is set to a value close to $D_{max}(f)$. On the other hand, as indicated by a dotted line 502 in 7*b* of FIG. 7, at a frequency at which $\sigma_{ILD}(f)$ is small, it is considered that it is difficult for a human to recognize a difference for each direction, and thus the directivity direction count is set to a value close to $D_{min}(f)$.

More specifically, if $\sigma_{ILD}(f)$ takes a value of about 0 dB to 15 dB, as shown in 7*b* of FIG. 7, $\sigma_{ILD}(f)$ is divided by 15 to be normalized, and defined as a direction sensitivity s(f) of the HRTFs for each frequency, which takes a value of 0 to 1. The directivity direction count which takes into consideration of the direction sensitivity of a human for each frequency can be determined within the range of $D_{min}(f)$ to $D_{max}(f)$, as indicated by $D(f)=D_{sens}(f)$ given by:

$$D_{sens}(f)=\text{round}(D_{min}(f)s(f)(D_{max}(f)-D_{min}(f))) \tag{6}$$

Note that s(f) is calculated from the HRTFs in the sound source direction of 0° to 180°, and can thus be interpreted as the average direction sensitivity in all the directions. Especially, this is considered to be appropriate since if the HRTFs are switched (head tracking processing is performed) in accordance with the head motion of the user in generating headphone reproduction signals (to be described later), the HRTFs in all the directions are used.

Note that at a frequency of, for example, 15 kHz or more at which it is difficult for the human to perceive a sound, $D_{sens}(f)$ may be set smaller by applying an appropriate attenuation curve to s(f) calculated from the HRTFs. FIG. 6A schematically shows an example of $D_{sens}(f)$ by a curve. Note that the four graphs in FIG. 6A corresponding to the directivity direction count take integer values, and thus they are actually stepwise.

In consideration of the above points, in step S212, the directivity direction count at each frequency is determined as $D(f)=D_{mean}(f)$ [equation (5)] or $D(f)=D_{sens}(f)$ [equation (6)] within the range of $D_{min}(f)$ to $D_{max}(f)$. Note that the value which has been calculated in advance from the HRTFs and held in the storage unit 102 is obtained and used as s(f) of equation (6).

In step S213, using the directivity direction count D(f) determined in step S212, the directivity direction $\theta_d(f)=(d-1)\times 360°/D(f)$ [d=1, . . . , D(f)] of each directivity is calculated, similarly to step S203. Note that a directivity direction exceeding 180° is represented by $\theta_d(f)\leftarrow\theta_d(f)-360°$.

Steps S214 to S216 are processes for each directivity for which the directivity direction has been calculated in step S213, and are performed in a directivity loop.

In step S214, a filter coefficient for forming a directivity set as a target in the current directivity loop is obtained, similarly to step S204. That is, $w_d(f)$ corresponding to the directivity direction $\theta_d(f)$ is obtained from the filter coefficients of the directivity forming filters held in advance in the storage unit 102.

In step S215, the filter coefficient $w_d(f)$ of the directivity forming filter obtained in step S214 is applied to the Fourier coefficient z(f) of the M channel audio signals obtained in step S201. This generates a direction sound $Y_d(f)$, which is data (Fourier coefficient) in the frequency domain, in the directivity direction $\theta_d(f)$ corresponding to the current directivity loop, as given by:

$$Y_d(f)=w_d^H(f)z(f) \tag{7}$$

In step S216, the HRTFs $[H_L(f, \theta_d(f)), H_R(f, \theta_d(f))]$ of the left and right ears in the same direction as the directivity direction $\theta_d(f)$ are applied to the Fourier coefficient $Y_d(f)$ of the direction sound in the directivity direction $\theta_d(f)$ obtained in step S215. The obtained values are added to the left and right headphone reproduction signals $X_L(f)$ and $X_R(f)$, which are data (Fourier coefficients) in the frequency domain, given by:

$$\begin{cases} X_L(f) \leftarrow X_L(f) + H_L(f, \theta_d(f))Y_d(f) \\ X_R(f) \leftarrow X_R(f) + H_R(f, \theta_d(f))Y_d(f) \end{cases} \tag{8}$$

Note that the HRTFs held in advance in the storage unit 102 are obtained and used.

By performing the processing in this step in the directivity loop, virtual speakers for reproducing direction sounds in the respective directivity directions are sequentially arranged around the user. By further performing the processing in this step in the frequency loop, the number of virtual speakers is controlled for each frequency in accordance with the directivity direction count D(f) determined in step S212. That is, since the number of virtual speakers is larger in the high frequency range than in the low frequency range, and the numbers of virtual speakers at all the frequencies fall within an appropriate range, the direction sense of the sound source is clear, and the volume balances in the respective directions are uniform.

Note that by appropriately controlling the directivity direction count D(f) for each frequency, the levels of the combined beam patterns at the respective frequencies become almost equal to each other. More strictly, gain adjustment may be performed for each frequency so that the levels of the combined beam patterns at all the frequencies have a constant value.

Note that, for example, the headphones 105 may include a sensor capable of detecting the head motion of the user. Head tracking processing of switching, in accordance with the head motion, the HRTFs to be used may be performed for every predetermined time frame length (audio frame) of the audio signal.

In step S217, inverse Fourier transform is performed for each of the Fourier coefficients $X_L(f)$ and $X_R(f)$ of the headphone reproduction signals generated in step S216, thereby obtaining headphone reproduction signals $x_L(t)$ and $x_R(t)$ as temporal waveforms.

In step S218, the audio signal output unit 104 performs D/A conversion and amplification for the headphone reproduction signals $x_L(t)$ and $x_R(t)$ obtained in step S217, thereby reproducing the resultant signals from the headphones 105.

Note that the processing may be performed in advance up to determination of each directivity direction for each frequency in steps S202 to S213, and the result may be held in the storage unit 102. In synchronism with obtaining of the audio signals in step S201, only audio rendering/reproduction processing in steps S214 to S218 may be performed in real time for each audio frame.

Note that the user may be allowed to control the directivity direction count D(f) for each of the low frequency range, medium frequency range, and high frequency range via, for example, a GUI unit (not shown) interconnected to the system control unit 101.

Note that in the first embodiment, only the direction sounds in the directivity directions $\theta_d(f)$ are generated in step S215, and the virtual speakers the number of which is equal to that of generated direction sounds are arranged in the same directions as the directivity directions $\theta_d(f)$ in step S216. In step S215, however, in addition to the direction sounds in the directivity directions $\theta_d(f)$, direction sounds in directions of 360° in which the main lobes have been made to face in all the horizontal directions at intervals of 1° may be generated. In step S216, among the generated direction sounds, only the direction sounds in the directivity directions $\theta_d(f)$ may be selectively used to arrange virtual speakers in only the same directions as the directivity directions $\theta_d(f)$.

Second Embodiment

In the aforementioned first embodiment, the directivity direction count and the virtual speaker count are controlled for each frequency by a combination of direction sound generation by directivity forming filtering in the (nondirectional) microphone array and binaural audio reproduction by the headphones. In the second embodiment, a directivity direction count and a use speaker count are controlled for each frequency by a combination of direction sound obtaining by a directional microphone array and surrounding speaker reproduction.

Figure 8:
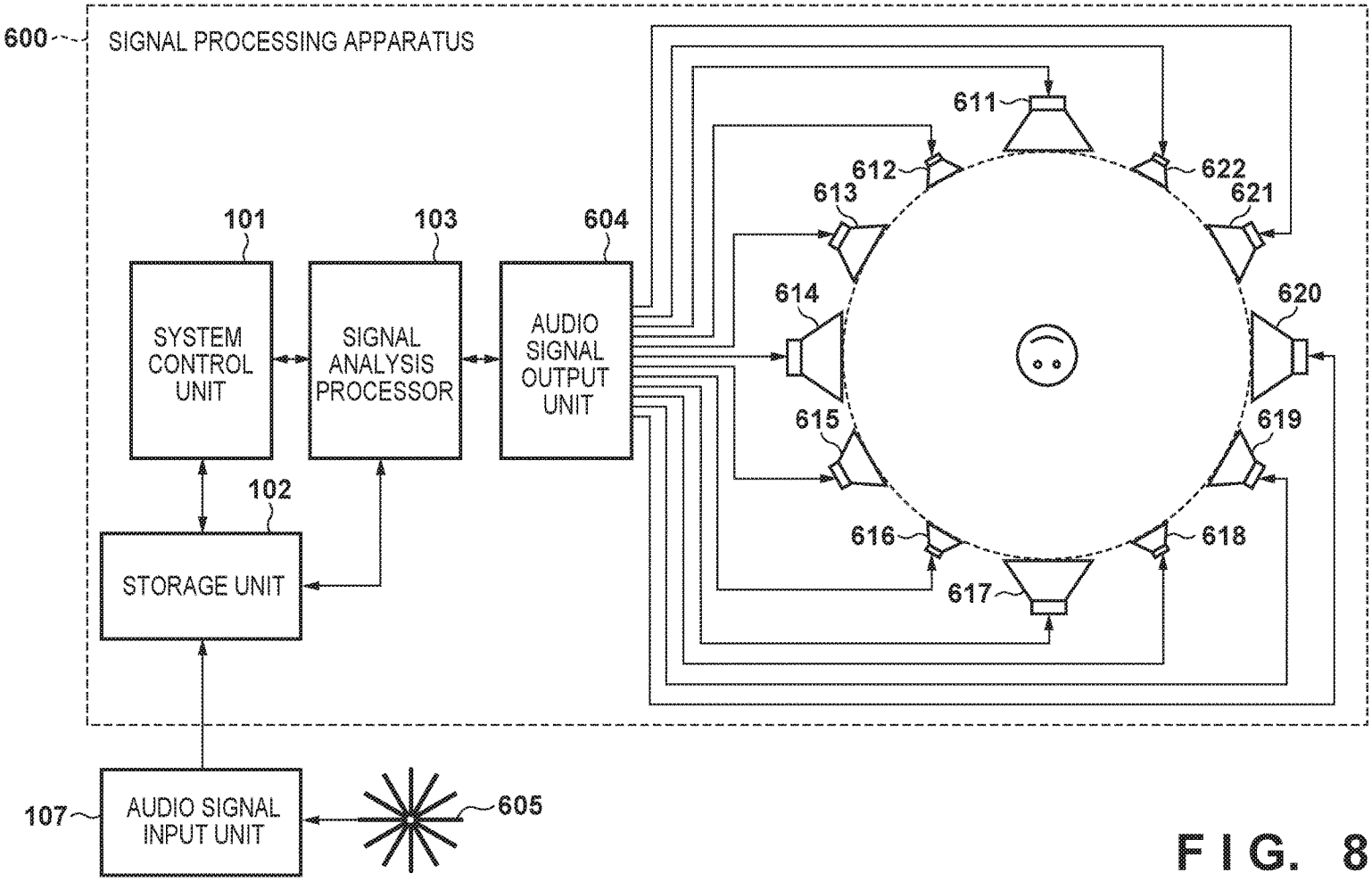
FIG. 8 is a block diagram showing a signal processing apparatus according to the second embodiment.

FIG. 8 is a block diagram showing the arrangement of a signal processing apparatus 600 according to this embodiment. The signal processing apparatus 600 includes a system control unit 101 for comprehensively controlling respective components, a storage unit 102 for storing various data, and a signal analysis processor 103 for performing signal analysis processing. The signal processing apparatus 600 includes a reproducing system as a generation means for generating direction sound images as sound images of direction sounds around the user. In this embodiment, the reproducing system includes, for example, an audio signal output unit 604, and a plurality of speakers 611 to 622 forming a plurality of channels (for example, 12 channels) arranged around the user (in the horizontal direction). The storage unit 102 holds 12 channel audio signals recorded by, via an audio signal input unit 107, a directional microphone array 605 of 12 channels in which 12 directional microphones are radially arranged in accordance with the number of arranged speakers 611 to 622 and their directions. Note that the present invention is not limited to the specific number of speakers. Note that surrounding speakers may be arranged in accordance with the number of arranged directional microphones used for sound recording and their directions.

The signal analysis processor 103 generates, by signal analysis processing (to be described later), speaker reproduction signals to be reproduced from the speakers 611 to 622. An audio signal output unit 104 performs D/A conversion and amplification for the generated speaker reproduction signals, and reproduces the resultant signals from the speakers 611 to 622.

Figure 9A:
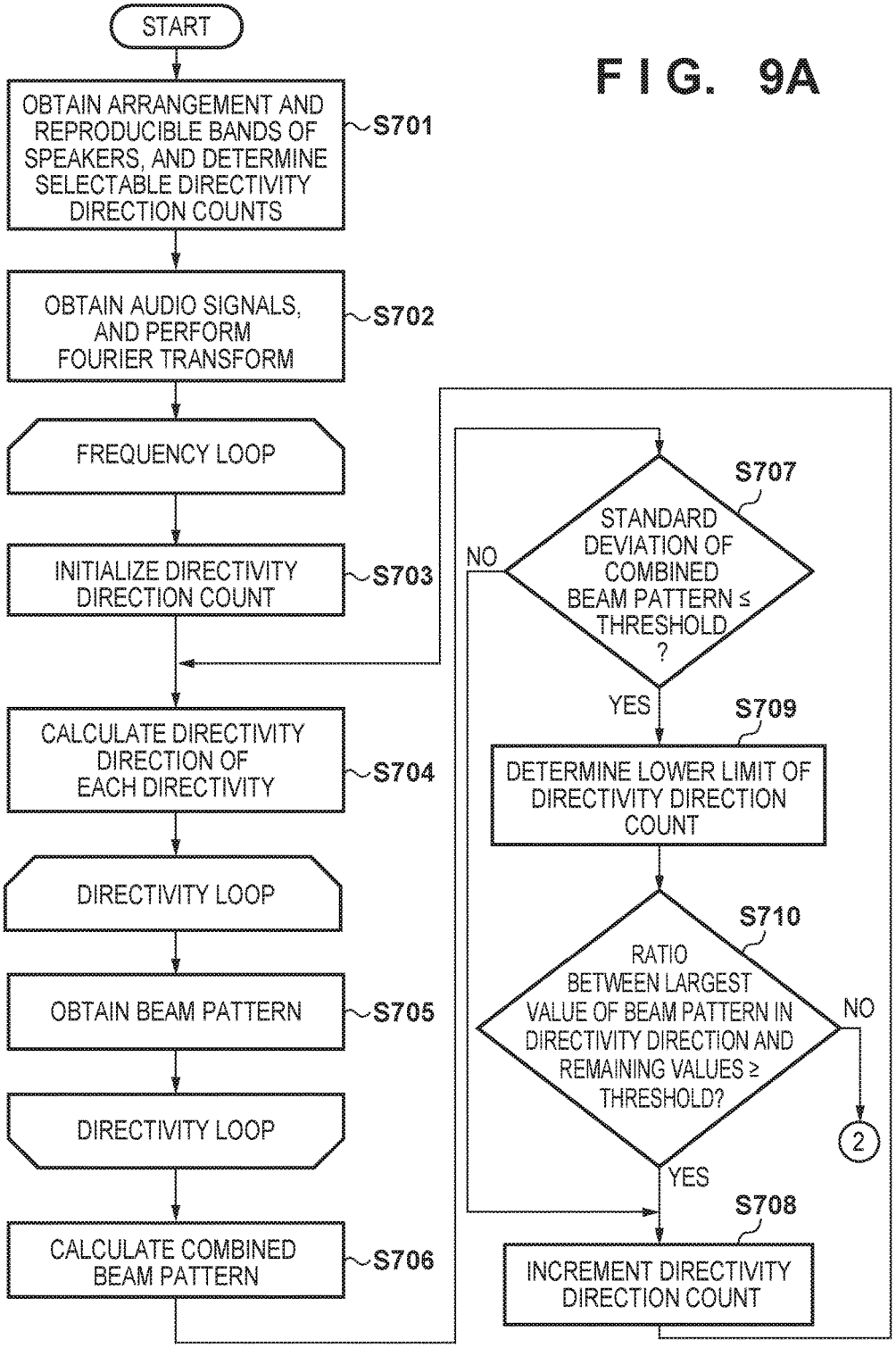
FIGS. 9A and 9B are flowcharts illustrating signal processing according to the second embodiment.
Figure 9B:
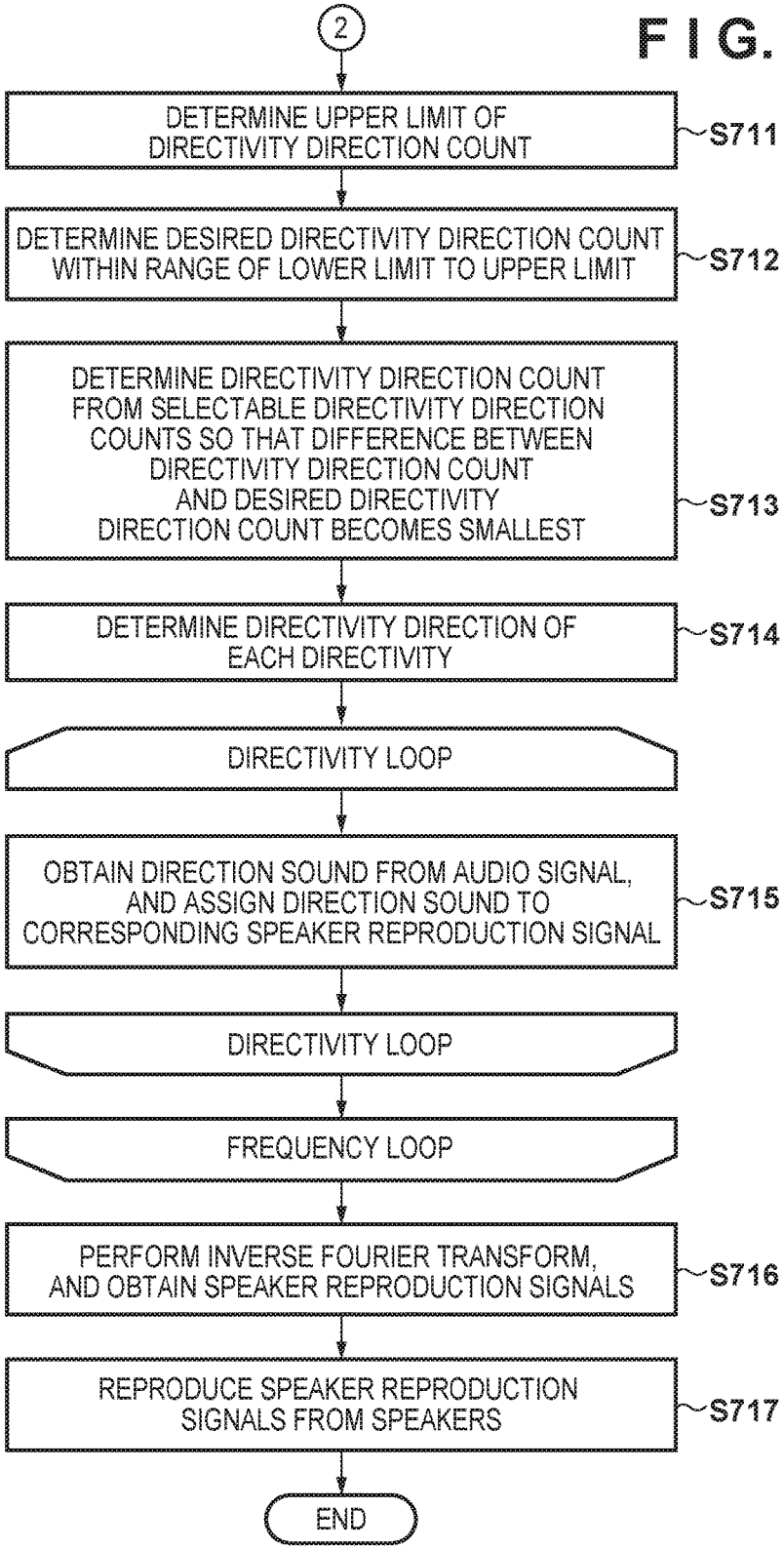

The signal analysis processing according to this embodiment will be described below with reference to flowcharts shown in FIGS. 9A and 9B. Note that programs corresponding to the flowcharts shown in FIGS. 9A and 9B are held in, for example, the storage unit 102, and executed by the signal analysis processor 103, unless otherwise specified.

In step S701, the arrangement and reproducible bands of the speakers 611 to 622 held in advance in the storage unit 102 are obtained, and a combination of the numbers of speakers usable for multi-directional reproduction at each frequency is determined based on the obtained information, and set as a directivity direction count $D_{sp}(f)$ selectable in a subsequent step. Note that the arrangement and reproducible bands of the surrounding speakers may be calculated by performing audio measurement using a microphone arranged at a listening point as the position of the user.

The selectable directivity direction count $D_{sp}(f)$ can be determined in accordance with the reproducible band of each of the plurality of speakers. Referring to FIG. 8, the large speakers 611, 614, 617, and 620 can perform reproduction from a low frequency range to a high frequency range, the medium speakers 613, 615, 619, and 621 can perform reproduction from a medium frequency range to a high frequency range, and the small speakers 612, 616, 618, and 622 can perform reproduction only in the high frequency range. Thus, a combination of the numbers of speakers which can be equally arranged and are usable for multi-directional reproduction at each frequency, that is, the directivity direction count $D_{sp}(f)$ selectable in the subsequent step is given by:

$$D_{sp}(f)=\{1,2,4\}[f<f_M]$$

$$D_{sp}(f)=\{1,2,3,4,6\}[f_M\leq f<f_H]$$

$$D_{sp}(f)=\{1,2,3,4,6,12\}[f_H\leq f]$$

where $f_M$ represents a boundary frequency between the low frequency range and the medium frequency range, and $f_H$ represents a boundary frequency between the medium frequency range and the high frequency range.

Processing in step S702 is the same as that in step S201 of the first embodiment and a description thereof will be omitted.

Steps S703 to S715 are processes for each frequency, and are performed in a frequency loop.

The processes in steps S703 and S704 are the same as those in steps S202 and S203 of the first embodiment and a description thereof will be omitted.

Step S705 is processing for each directivity for which a directivity direction has been calculated in step S704, and is performed in a directivity loop.

In step S705, the beam pattern of the directivity set as a target in the current directivity loop is obtained. That is, a beam pattern $b_d(f, \theta)$, held in advance in the storage unit 102, when a directional microphone is made to face in a directivity direction $\theta_d(f)$ is obtained. Note that the beam pattern of the directional microphone is obtained by measurement, simulation, or the like. Note that the beam pattern is different depending on the type of the directional microphone. Therefore, the type ID of the directional microphone used for sound recording may be recorded as additional information of the audio signals at the time of sound recording, and a beam pattern corresponding to the directional microphone may be obtained in this step. Note that by rotating a beam pattern $b_1(f, \theta)$ when the directional microphone is made to face in the front direction of 0°, it is possible to obtain a beam pattern $b_d(f, \theta)$ [d=2, . . . ] when the directional microphone is made to face in another directivity direction $\theta_d(f)$.

The processes in steps S706 to S711 are the same as those in steps S206 to S211 of the first embodiment and a description thereof will be omitted.

Similarly to step S212 of the first embodiment, in step S712, the directivity direction count at each frequency is determined, as indicated by $D_{mean}$ (f) [equation (5)] or $D_{sens}$ (f) [equation (6)]. The determined directivity direction count will be referred to as a "predetermined directivity direction count" hereinafter.

In step S713, the directivity direction count D(f) at each frequency is determined from the selectable directivity direction counts $D_{sp}(f)$ determined in step S701 so that the difference between the directivity direction count D(f) and the predetermined directivity direction count determined in step S712 becomes small (for example, smallest). If, for example, the predetermined directivity direction count is $D_{mean}$ (f), D(f)=4 [$f > f_M$], D(f)=6 [$f_M \le f < f_D$], and D(f)=12 [$f_D \le f$] are obtained, as indicated by thick horizontal lines in FIG. 6B, where $f_D$ represents a frequency at which $D_{mean}$=(6+12)/2=9 is obtained. Alternatively, if the predetermined directivity direction count is $D_{sens}(f)$, frequencies at which the same directivity direction count is obtained are not always continuous, and can be discontinuous.

The processing in step S714 is the same as that in step S213 of the first embodiment and a description thereof will be omitted.

In step S715, a direction sound in the directivity direction $\theta_d(f)$ is obtained from the audio signal obtained in step S702, and assigned to a corresponding speaker reproduction signal. In this embodiment, the audio signals are recorded by a directional microphone array, and the audio signal of the channel corresponding to the directivity direction $\theta_d(f)$ is directly set as a direction sound. Thus, this direction sound is assigned to the speaker reproduction signal of the corresponding channel.

The mth element of a Fourier coefficient (vector) z(f) of the 12 channel audio signals is represented by $z_m(f)$ [m=1, . . . , 12]. With respect to the speakers 611 to 622 of the 12 channels, the Fourier coefficient of each speaker reproduction signal is represented by $X_s(f)$ [s=1, . . . , 12]. When the directivity direction count D(f)=4 is set, consider frequencies at which the respective directivity directions are as follows.

$$\theta_1(f)=0°$$

$$\theta_2(f)=90°$$

$$\theta_3(f)=180°$$

$$\theta_4(f)=-90°$$

In this case, $$X_i(f)=z_i(f)[i=1,4,7,10]$$

$$X_j(f)=0[j=2,3,5,6,8,9,11,12]$$

When the directivity direction count D(f)=6 is set, consider frequencies at which the respective directivity directions are as follows.

$$\theta_1(f)=0°$$

$$\theta_2(f)=60°$$

$$\theta_3(f)=120°$$

$$\theta_4(f)=180°$$

$$\theta_3(f)=-120°$$

$$\theta_6(f)=-60°$$

In this case, $$X_i(f)=z_i(f)[i=1,3,5,7,9,11]$$

$$X_j(f)=0[j=2,4,6,8,10,12]$$

When the directivity direction count D(f)=12 is set, consider frequencies at which the respective directivity directions are as follows.

$$\theta_1(f)=0°$$

$$\theta_2(f)=30°$$

$$\theta_3(f)=60°$$

$$\theta_4(f)=90°$$

$$\theta_3(f)=120°$$

$$\theta_6(f)=150°$$

$$\theta_7(f)=180°$$

$$\theta_8(f)=-150°$$

$$\theta_9(f)=-120°$$

$$\theta_{10}(f)=-90°$$

$$\theta_{11}(f)=-60°$$

$$\theta_{12}(f)=-30°$$

In this case, $$X_i(f)=z_i(f)[i=1, . . . ,12]$$

Figure 6B:
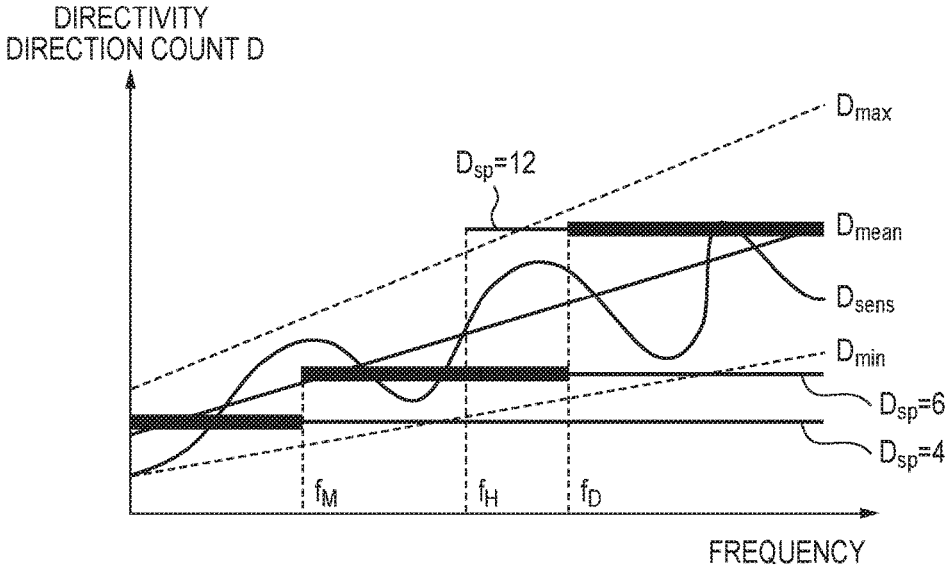

As indicated by the thick horizontal lines in FIG. 6B, when D(f)=4 [$f < f_M$], D(f)=6 [$f_M \le f < f_D$], and D(f)=12 [$f_D \le f$], the direction sounds at frequencies lower than the frequency $f_M$ are reproduced from the four speakers 611, 614, 617, and 620. The direction sounds at frequencies falling within the range of the frequency $f_M$ (inclusive) to the frequency $f_D$ (exclusive) are reproduced from the six speakers 611, 613, 615, 617, 619, and 621. The direction sounds at frequencies equal to or higher than the frequency $f_D$ are reproduced from all the 12 speakers 611 to 622. This is a new type of surround arrangement in which the number of speakers is larger in a higher frequency range.

In step S716, inverse Fourier transform is performed for each of the Fourier coefficients $X_s(f)$ of the speaker reproduction signals generated in step S715, thereby obtaining speaker reproduction signals $x_s(t)$ [s=1, . . . , 12] as temporal waveforms.

In step S717, the audio signal output unit 104 performs D/A conversion and amplification for the speaker reproduction signals $x_s(t)$ obtained in step S716, thereby reproducing the resultant signals from the speakers 611 to 622.

According to the above-described embodiment, by controlling the directivity direction count for each frequency, the direction sense of the sound source becomes clear, and the sound volume balances in the respective directions become uniform.

Note that the various data held in advance in the storage unit 102 in the above embodiment may be external input via a data input/output unit (not shown) interconnected to the system control unit 101.

The following embodiments can be arranged by appropriately combining the above first and second embodiments. These embodiments are incorporated in the scope of the present invention. That is, an embodiment of controlling the directivity direction count and the use speaker count for each frequency can be arranged by combining a direction sound generation by directivity forming filtering in a (nondirectional) microphone array and surrounding speaker reproduction. In addition, an embodiment of controlling the directivity direction count and the virtual speaker count for each frequency can be arranged by combining direction sound obtaining in the directional microphone array and binaural audio reproduction in the headphones.

Note that the signal processing apparatus 100 may have sound recording (microphone array), shooting (camera), and display (display) functions in addition to the reproduction (headphones and speakers) function. In this case, if the shooting/sound recording system and the display/reproducing system operate at remote sites in synchronism with each other, a remote live system can be implemented.

Note that in the above embodiments, the direction sense of the sound source becomes clear in all the horizontal directions, and the volume balances become uniform. However, a target direction range may be arbitrarily set. For example, all directions including not only the horizontal directions but also elevation angle directions may be set as a target direction range or the target direction range may be limited to a horizontal forward half surface or the range of the angle of view of a shot video signal. In this case, a standard deviation as a measure of the recess amount of a combined beam pattern is calculated from the combined beam pattern within the target direction range instead of all the horizontal directions.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-169731, filed Aug. 28, 2015, which is hereby incorporated by reference herein in its entirety.

What is claimed is:

1. A signal processing apparatus comprising:

at least one hardware processor; and a memory which stores instructions executable by the at least one hardware processor to cause the signal processing apparatus to perform at least:

obtaining, based on audio signals picked up by a plurality of sound pickup units, one or more directional sound signals corresponding to a specific frequency range; and generating audio signals for reproduction by using a first number of directional sound signals corresponding to a first specific frequency range obtained in the obtaining and a second number of directional sound signals corresponding to a second specific frequency range obtained in the obtaining, wherein the first number is larger than the second number, and wherein the first number of directional sound signals have directivity in different directions respectively.

2. The signal processing apparatus according to claim 1, wherein in the obtaining, the first number of directional sound signals are obtained by applying directivity forming filters corresponding to the different directions to the audio signals picked up by the plurality of sound pickup units, respectively.

3. The signal processing apparatus according to claim 1, wherein the plurality of sound pickup units are directional microphones, each of which is configured to pick up a sound in a specific direction, and in the obtaining, a first number of channels of audio signals output from the plurality of sound pickup units are obtained as the first number of directional sound signals.

4. The signal processing apparatus according to claim 1, wherein the first specific frequency range is higher than the second specific frequency range.

5. The signal processing apparatus according to claim 1, wherein the instructions further cause the signal processing apparatus to perform:

determining a lower limit number of directional sound signals used in the generating so that a recess amount of a combined beam pattern obtained by combining beam patterns of the directional sound signals is not larger than a threshold.

6. The signal processing apparatus according to claim 1, wherein the instructions further cause the signal processing apparatus to perform:

determining an upper limit number of directional sound signals used in the generating so that an amount of overlapping of beam patterns of the directional sound signals is not larger than a threshold.

7. The signal processing apparatus according to claim 6, wherein the upper limit number of directional sound signals is determined so that a ratio between a largest value and remaining values is not smaller than a threshold with respect to the values in the directions of the beam patterns of the respective directivities.

8. The signal processing apparatus according to claim 1, wherein the instructions further cause the signal processing apparatus to perform:

reproducing the audio signals for reproduction generated in the generating.

9. The signal processing apparatus according to claim 8, wherein in the generating, the audio signals for reproduction are generated by applying, to each directional sound signal, head-related transfer functions corresponding to each directivity respectively, and in the reproducing, the audio signals for reproduction generated in the generating are reproduced near both ears of the user.

10. The signal processing apparatus according to claim 8, wherein in the reproducing, the audio signals for reproduction generated in the generating are reproduced by a plurality of speakers arranged around the user.

11. The signal processing apparatus according to claim 8, wherein in the generating, the first number and the second number are determined in accordance with the frequency-specific direction sensitivity of head-related transfer functions.

12. The signal processing apparatus according to claim 11, wherein the direction sensitivity indicates a change amount with respect to a direction of an interaural level difference of the head-related transfer functions.

13. The signal processing apparatus according to claim 10, wherein the instructions further cause the signal processing apparatus to perform:

determining one of selectable number of directional sound signals as the first number or the second number so that a difference between the determined number of directional sound signals and a predetermined number of directional sound signals is minimized.

14. The signal processing apparatus according to claim 13, wherein the selectable number of directional sound signals is determined in accordance with a reproducible frequency range of each of the plurality of speakers.

15. The signal processing apparatus according to claim 1, wherein central directions of directivities of the first number of directional sound signals are different from each other, and central directions of directivities of the second number of directional sound signals are different from each other.

16. A signal processing method of controlling, the method comprising:

obtaining, based on audio signals picked up by a plurality of sound pickup units, one or more directional sound signals corresponding to a specific frequency range; and generating audio signals for reproduction by using a first number of directional sound signals corresponding to a first specific frequency range obtained in the obtaining and a second number of directional sound signals corresponding to a second specific frequency range obtained in the obtaining, wherein the first number is larger than the second number, and wherein the first number of directional sound signals have directivity in different directions respectively.

17. A non-transitory computer-readable storage medium storing a program for causing a computer to perform signal processing steps comprising:

obtaining, based on audio signals picked up by a plurality of sound pickup units, one or more directional sound signals corresponding to a specific frequency range; and generating audio signals for reproduction by using a first number of directional sound signals corresponding to a first specific frequency range obtained in the obtaining and a second number of directional sound signals corresponding to a second specific frequency range obtained in the obtaining, wherein the first number is larger than the second number, and wherein the first number of directional sound signals have directivity in different directions respectively.

* * * * *